US007055486B2

(12) United States Patent
Hoff et al.

(10) Patent No.: US 7,055,486 B2
(45) Date of Patent: Jun. 6, 2006

(54) FLUID DELIVERY CONTROL SYSTEM

(75) Inventors: Brian D. Hoff, East Peoria, IL (US); Kris William Johnson, Washington, IL (US); Marcelo C. Algrain, Peoria, IL (US); Sivaprasad Akasam, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/742,885

(22) Filed: Dec. 23, 2003

(65) Prior Publication Data

US 2004/0187835 A1 Sep. 30, 2004

Related U.S. Application Data

(60) Provisional application No. 60/458,460, filed on Mar. 28, 2003.

(51) Int. Cl.
*F01M 1/00* (2006.01)

(52) U.S. Cl. ..... 123/196 R

(58) Field of Classification Search ..... 123/196 R, 123/73 AD, 497, 446
See application file for complete search history.

(56) References Cited

U.S. PATENT DOCUMENTS 2,838,039 A 6/1958 Smith et al.
4,206,634 A * 6/1980 Taylor et al. ..... 73/119 A
4,458,644 A 7/1984 Papst
4,531,485 A 7/1985 Murther
4,638,771 A * 1/1987 Mori ..... 123/73 AD
4,642,604 A 2/1987 Glesmann et al.
4,741,304 A 5/1988 Martin et al.
5,063,895 A 11/1991 Ampferer
5,085,181 A 2/1992 Feuling
5,121,720 A 6/1992 Roberts
5,168,845 A 12/1992 Peaker
5,247,914 A 9/1993 Imai et al.
5,339,776 A 8/1994 Regueiro
5,511,522 A 4/1996 Tran
5,526,783 A 6/1996 Ito et al.
5,743,231 A 4/1998 Reinosa
5,749,339 A 5/1998 Graham et al.
5,765,521 A 6/1998 Stützle et al.
5,845,756 A 12/1998 Dairokuno et al.
5,884,601 A 3/1999 Robinson
5,901,811 A 5/1999 Samples et al.
5,944,632 A 8/1999 Hara et al.
6,269,788 B1 8/2001 Kachelek
6,598,391 B1 7/2003 Lunzman et al.
6,666,185 B1 * 12/2003 Willi et al. ..... 123/299

FOREIGN PATENT DOCUMENTS

JP 2000328916 A * 11/2000

* cited by examiner

*Primary Examiner*—Noah P. Kamen
(74) *Attorney, Agent, or Firm*—Finnegan, Henderson, Farabow, Garrett & Dunner LLP

(57) ABSTRACT

A method of controlling the delivery of fluid to an engine includes receiving a fuel flow rate signal. An electric pump is arranged to deliver fluid to the engine. The speed of the electric pump is controlled based on the fuel flow rate signal.

16 Claims, 6 Drawing Sheets

FLUID DELIVERY CONTROL SYSTEM

CLAIM FOR PRIORITY

This application claims the benefit of U.S. Provisional Application No. 60/458,460, filed Mar. 28, 2003.

U.S. GOVERNMENT RIGHTS

This invention was made with government support under the terms of Contract No. DE-FC04-2000AL67017 awarded by the Department of Energy. The government may have certain rights in this invention.

TECHNICAL FIELD

This invention relates generally to fluid delivery systems for internal combustion engines, and more particularly to control systems for controlling fluid delivery to internal combustion engines.

BACKGROUND

Conventional internal combustion engines are typically lubricated with a mechanical pump powered by the engine via belts or gears. The speed of the pump, and therefore the oil pressure and rate of oil flow, are a function of the engine speed. Auxiliary electrically operated oil pumps have been used to operate at engine start-up to ensure oil flow to the engine as soon as possible.

Oil not only lubricates engine parts, but oil is also important in engine cooling. It is important that sufficient oil pressure be provided to float the engine bearings and prevent metal-to-metal contact. With the use of a mechanical oil pump powered by the engine, the amount of lubrication and cooling of the engine is dependent on engine speed and is not relative to the work load of the engine.

U.S. Pat. No. 5,884,601 to Robinson discloses a variable speed electric pumping system that controls the speed of an electric oil pump based on engine load. Engine load is determined by monitoring an engine speed signal received from an engine RPM sensor. Robinson also discloses receiving an oil pressure signal from an oil pressure sensor and controlling the oil pump speed to maintain a designed specification oil pressure. Robinson discloses that this compensates for the tendency of the oil pressure to decrease as the engine wears.

The disclosure of Robinson, however, does not describe any method of determining engine load other than by sensing engine speed from an engine RPM sensor. Sensing engine RPM is often an inadequate method for determining the load on an engine and for determining the lubrication requirements of the engine. For example, a truck traveling up a steep hill at a given engine RPM may have a much higher torque on the engine than the same truck traveling down a hill at the same engine RPM. The torque on the truck engine traveling uphill will be much higher and, consequently, there will be more force exerted on the engine bearings and the engine bearings will be more prone to wear. Thus, an oil pump control system that controls the oil pump based solely on engine RPM will not be able to provide adequate lubrication to an engine under all load conditions without wasting a significant amount of pumping energy.

The present invention provides a fluid delivery control system that avoids some or all of the aforesaid shortcomings in the prior art.

SUMMARY OF THE INVENTION

In accordance with one aspect of the disclosure, a method of controlling the delivery of fluid to an engine includes receiving a fuel flow rate signal. An electric pump is arranged to deliver fluid to the engine. The speed of the electric pump is controlled based on the fuel flow rate signal.

In accordance with another aspect of the disclosure, an electric pump control system controls delivery of fluid to an engine. A pump is arranged to pump fluid to an engine. An electric motor is arranged to drive the pump. A controller is operatively coupled to the electric motor. The controller controls the speed of the electric motor in response to a fuel flow rate signal.

In accordance with another aspect of the disclosure, a method of controlling the delivery of fluid to an engine includes receiving a sensed oil pressure signal. A desired oil pressure is determined based on engine torque. An electric pump is arranged to deliver fluid to the engine. The speed of the electric pump is controlled based on the desired oil pressure and the sensed oil pressure signal.

In accordance with another aspect of the disclosure, a method of controlling the delivery of fluid to an engine includes determining a value representative of engine torque and controlling the speed of an electric pump arranged to deliver fluid to the engine based on the engine torque.

DETAILED DESCRIPTION

Reference will now be made in detail to the exemplary embodiments of the invention which are illustrated in the accompanying drawings. Wherever possible, the same reference numbers will be used throughout the drawings to refer to the same or like parts.

Figure 1:
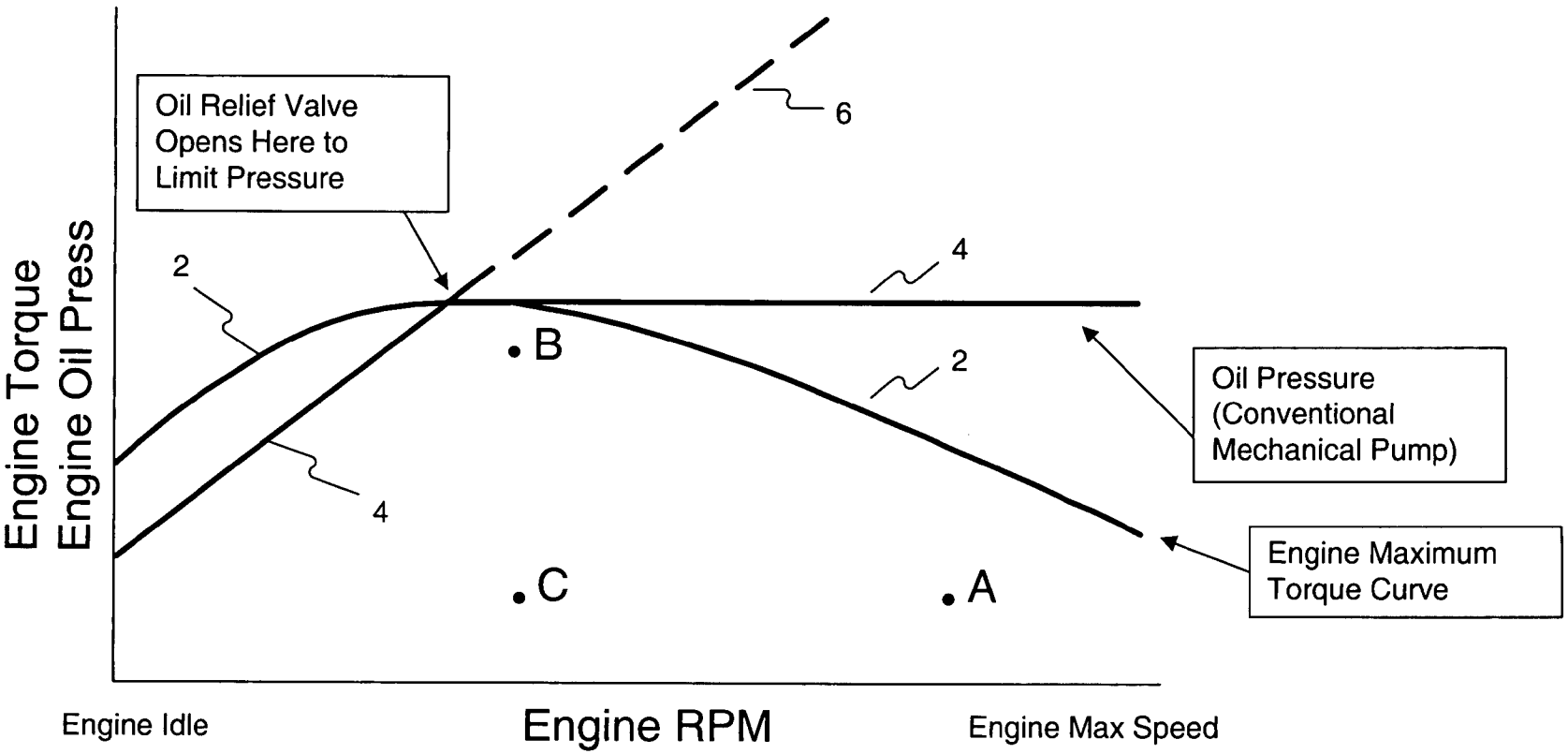
FIG. 1 is a graph illustrating maximum engine torque as a function of engine RPM, and also illustrating the engine oil pressure provided by a conventional mechanical oil pump.

FIG. 1 depicts a set of curves illustrating the relationship between maximum engine torque and the engine oil pressure provided by a conventional mechanical oil pump. Maximum engine torque curve 2 illustrates the maximum engine torque that can be provided by a particular engine as a function of engine RPM. As engine RPM increases from an idle condition, the maximum engine torque initially increases until it reaches a peak and then decreases as engine RPM further increases.

As mentioned previously, a conventional internal combustion engine is typically lubricated with a mechanical oil pump powered by the engine via belts or gears. The mechanical oil pump speed is thus proportional to engine speed. Curve 4 illustrates the engine oil pressure provided by a conventional mechanical pump. As engine RPM increases from an engine idle condition, the mechanical pump speed increases proportionally causing a linear increase in engine oil pressure. This provides increased lubrication and cooling to the engine as engine RPM increases. When engine RPM reaches the speed at which the maximum engine torque curve 2 is at its peak, an oil pressure relief valve opens. For all engine speeds above this point, the pressure relief valve remains open. This bleeds off excess oil pressure, keeping the oil pressure at a constant level for all engine speeds above this point. Engine oil pressure curve 4 is designed so that adequate lubrication is provided to the engine when it is loaded with its maximum torque over a range of speeds.

Although oil pressure remains essentially constant for engine speeds greater than the point at which the pressure relief valve opens, the oil pump speed continues to increase as engine RPM increases. If not for the opening of the pressure relief valve, the oil pressure would follow dashed line 6. Because the oil pump is turning faster than is needed to provide adequate lubrication to the engine, oil pumping power is wasted. The excess oil that is bled through the pressure relief valve represents wasted oil pumping energy. The wasted energy takes the form of heat added to the oil, which is then rejected via the engine's cooling system.

When the engine is running at point C (see FIG. 1), the torque on the engine is less than at point B, although the engine speed is the same at the two points. The engine bearings are consequently under less pressure when the engine is running at point C than at point B, even though the engine is operating at the same speed at points C and B. A conventional mechanical pump system would provide the same oil pressure at points B and C, because the engine is operating at the same speed at points B and C. In contrast, the oil pumping system disclosed herein provides increased oil pressure at point B to account for the increase in engine torque and the consequent increase in force placed on the bearings. Thus, for example, if a truck travels down a hill and then travels up a hill, the oil pumping system will increase oil pressure when the truck travels up the hill to account for the increased torque, even if the engine speed remains constant. The increased oil pressure is needed to account for the increased force on the bearings at increased torque levels. By reducing the oil pressure when the truck travels down hill (i.e. when engine torque decreases), the oil pumping system can ensure that oil pumping power is used efficiently and not wasted, while still ensuring that adequate lubrication and cooling is provided to the engine.

An engine operating at point A has the same torque as at point C, but is operating at a higher speed at point A. As will be described in more detail below, in a first embodiment, the oil pumping system can provide a constant oil pressure at a given engine torque without varying oil pressure as a function of engine speed. In a second embodiment, the oil pumping system can increase oil pressure as engine speed increases—thus oil pressure will be a function of both engine torque and engine speed.

Figure 2:
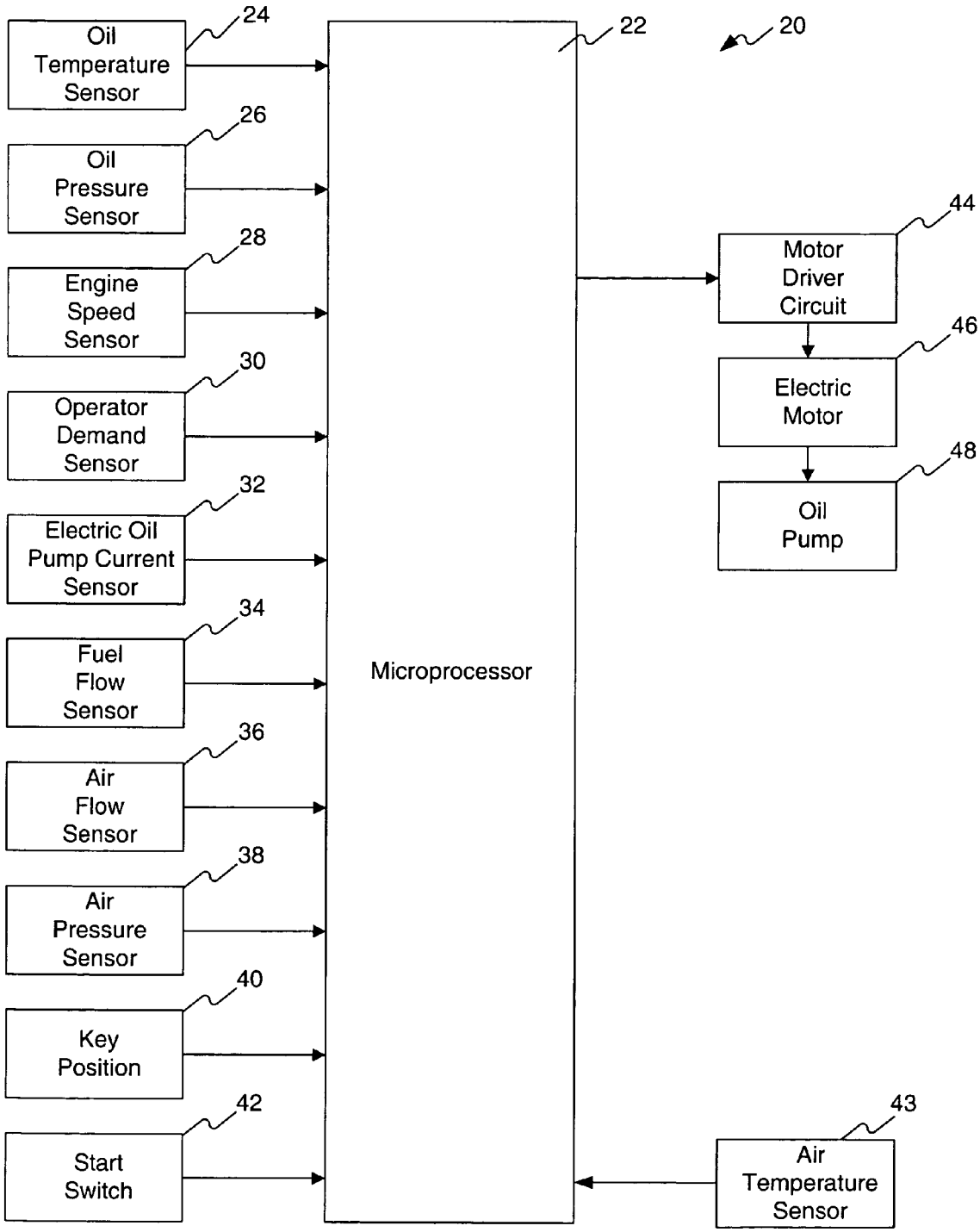
FIG. 2 is a block diagram illustrating an exemplary pump control system of the present disclosure.

FIG. 2 illustrates an oil pump control system 20 according to an exemplary embodiment of the present disclosure. The pump controller can be implemented as a microprocessor 22, which controls the speed of the electric oil pump based on various inputs. Microprocessor 22 can be the engine control unit (ECU), the processor which controls operation of the engine, or alternatively, microprocessor 22 can be implemented as a separate processor for controlling the oil pump. Alternatively, the pump controller can be implemented as multiple processors.

Microprocessor 22 receives a series of inputs from various sensors. FIG. 2 depicts examples of inputs that may be provided to microprocessor 22. Oil temperature sensor 24 may be located in the oil sump and provides a signal representative of the oil temperature in the oil sump. Oil pressure sensor 26 may be located in the oil gallery rail leading into the engine block. Oil pressure sensor 26 provides a signal representative of oil pressure. Engine speed sensor 28 may be coupled to the crankshaft. Engine speed sensor 28 senses engine RPM and outputs a signal representing engine speed. Operator demand sensor 30 provides a signal representing the engine demand requested by an operator of a vehicle or machinery containing the engine. Operator demand sensor 30 senses the load demand that is requested by the operator. For example, operator demand sensor 30 can sense the amount by which an operator depresses an accelerator pedal in a vehicle. Alternatively, operator demand sensor 30 can sense the demand requested by a cruise control system.

Electric oil pump current sensor 32 senses the current drawn by the electric motor coupled to the oil pump. Fuel flow sensor 34 senses the rate of fuel flow delivered to the engine. Air flow sensor 36 senses the rate of air flow delivered to the engine. Air pressure sensor 38 senses the air pressure at the intake manifold of the engine. Air temperature sensor 43 senses the air temperature at the intake manifold of the engine. Key position 40 senses the position of the key that is used to start the vehicle or other machinery that contains the engine. Key position 40 provides, for example, a signal representing various key positions such as Off, Accessory, Run, and Start. Start switch 42 provides a signal indicating whether the Start pushbutton has been depressed.

Microprocessor 22 outputs an output signal to motor driver circuit 44. Motor driver circuit 44 provides electric power to drive electric motor 46. Electric motor 46 is operatively coupled to drive oil pump 48. Oil pump 48 pumps oil or other fluid to the engine thereby providing sufficient pressure to float the bearings and prevent metal-to-metal contact. Oil or other fluid is also sprayed on the engine pistons and/or other engine surfaces for the purpose of cooling the engine.

Figure 3:
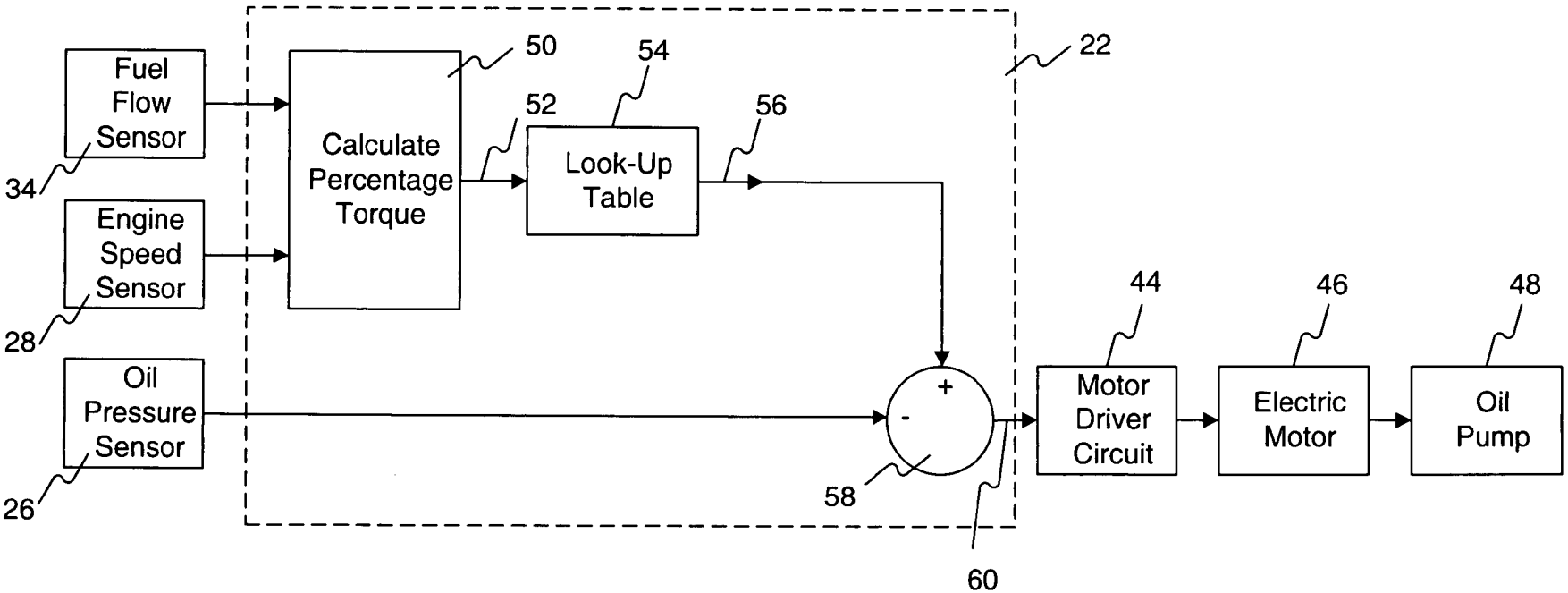
FIG. 3 is a block diagram illustrating a feedback control loop for controlling the delivery of fluid to the engine based on engine torque.

FIG. 3 depicts a block diagram illustrating an exemplary control algorithm of the present invention executed by the pump controller (microprocessor 22). Microprocessor 22 receives a fuel flow signal from fuel flow sensor 34. The fuel flow signal represents the rate of fuel flow to the engine. Microprocessor 22 also receives an engine speed signal from engine speed sensor 28. At block 50, microprocessor 22 calculates engine torque. Engine torque can be determined in a number of ways. Fuel flow rate is the primary variable used to determine engine torque. Other variables, such as engine speed, air pressure at the intake manifold, and air temperature may be used to obtain a more precise value of engine torque.

One method of determining engine torque is to calculate engine torque as a linear function of fuel flow rate. Thus, when the engine is operating at 100% fuel flow rate, microprocessor 22 determines that engine torque is at 100% of the maximum engine torque. When the engine is operating at 50% fuel flow rate, microprocessor determines that engine torque is at 50% of the maximum engine torque.

Other approximations of engine torque may be used other than a linear relationship to provide a more accurate determination of engine torque. A curve showing engine torque as a function of fuel flow rate for a particular engine can be generated experimentally or based on conventional equations. This curve can be programmed into microprocessor 22. Microprocessor 22 thereby determines engine torque based on fuel flow rate using such a curve (or using equations that represent the curve).

A closer approximation of engine torque can be used by determining engine torque as a function of both fuel flow rate and engine speed. An engine speed signal is received from engine speed sensor 28. As before, a set of curves can be generated that show engine torque as a function of both fuel flow rate and engine speed. The curves can be generated experimentally for a particular engine or based on conventional equations. Microprocessor 22 uses these curves (or equations representing such curves) to calculate engine torque as a function of fuel flow rate and engine speed. Other signals may be used by microprocessor 22 to further refine the determination of engine torque. For example, air pressure at the intake manifold, air temperature, air flow, and other inputs can be used to further determine engine torque. These signals are provided by sensors shown in FIG. 2.

Microprocessor 22 can also use a signal from operator demand sensor 30 to calculate the predicted torque on the engine. For example, if an operator of a vehicle pushes on the accelerator pedal, microprocessor 22 can predict the extent to which engine torque will increase using either conventional equations or experimentally determined response characteristics. Microprocessor 22 can then increase oil pressure to match the predicted engine torque.

Block 50 in microprocessor 22 outputs a percentage torque signal 52 representing the percentage of the maximum torque that the engine is capable of outputting, a value between 0 and 100 percent. The term "signal" as used herein can refer to an analog signal, a digital signal, or simply a data value determined by the microprocessor. Percentage torque signal 52 is provided to a look-up table 54 to determine a desired oil pressure signal 56. Look-up table 54 outputs a desired oil pressure signal 56. Look-up table 54 contains a series of values representing the desired oil pressure at different levels of engine torque ranging from 0 to 100 percent engine torque. The desired oil pressure values that are programmed into look-up table 54 are chosen based on the cooling and lubrication requirements of the engine at each percentage torque. Sufficient oil pressure must be provided at a given engine torque to prevent metal-to-metal contact of the engine bearings, and to provide adequate cooling to the engine. As an alternative to look-up table 54, the microprocessor can execute one or more calculations that provide desired oil pressure as a function of torque.

Alternatively, microprocessor 22 can determine the desired oil pressure based on calculating a parameter related to engine torque, such as engine power output. For example, microprocessor can calculate the engine power output based on engine torque and engine speed. The engine power output can then be used as an input to look-up table 54 to determine a desired oil pressure.

Microprocessor 22 uses a feedback control loop to control operation of the oil pump 48 to produce the desired oil pressure. Microprocessor 22 receives an oil pressure signal from oil pressure sensor 26. The oil pressure signal is provided to the negative input of summer 58. The desired oil pressure signal 56 is provided to the positive input of summer 58. Summer 58 outputs an error signal 60 representing the difference between the desired oil pressure and the sensed oil pressure. Microprocessor 22 outputs error signal 60 to electric motor driver circuit 44. If the error signal 60 is a positive value, then desired oil pressure is greater than the sensed oil pressure. Motor driver circuit 44 responds to a positive error signal by increasing the speed of electric motor 46. If the error signal 60 is a negative value, then the desired oil pressure is less than the sensed oil pressure. Motor driver circuit 44 responds to a negative error signal by decreasing the speed of electric motor 46. Electric motor 46 drives oil pump 48 in accordance with the drive signal received from motor driver circuit 44.

As an alternate feature, microprocessor 22 can determine desired oil pressure 56 based on other criteria in addition to engine torque. For example, microprocessor 22 can determine the desired oil pressure based on oil temperature and/or engine speed, in addition to engine torque. At higher engine speeds, there is more friction on the bearings and thus may require a slightly increased oil pressure even if engine torque remains constant. At high oil temperatures, the oil provides less cooling and thus may require slightly increased oil pressure to adequately cool the engine even if engine torque remains constant. Thus, the desired oil pressure determined by microprocessor 22 will increase as oil temperature increases and/or as engine speed increases, even if engine torque remains constant. In other words, oil pumping speed at a given engine torque will increase at higher oil temperatures and/or higher engine speeds.

Figure 4:
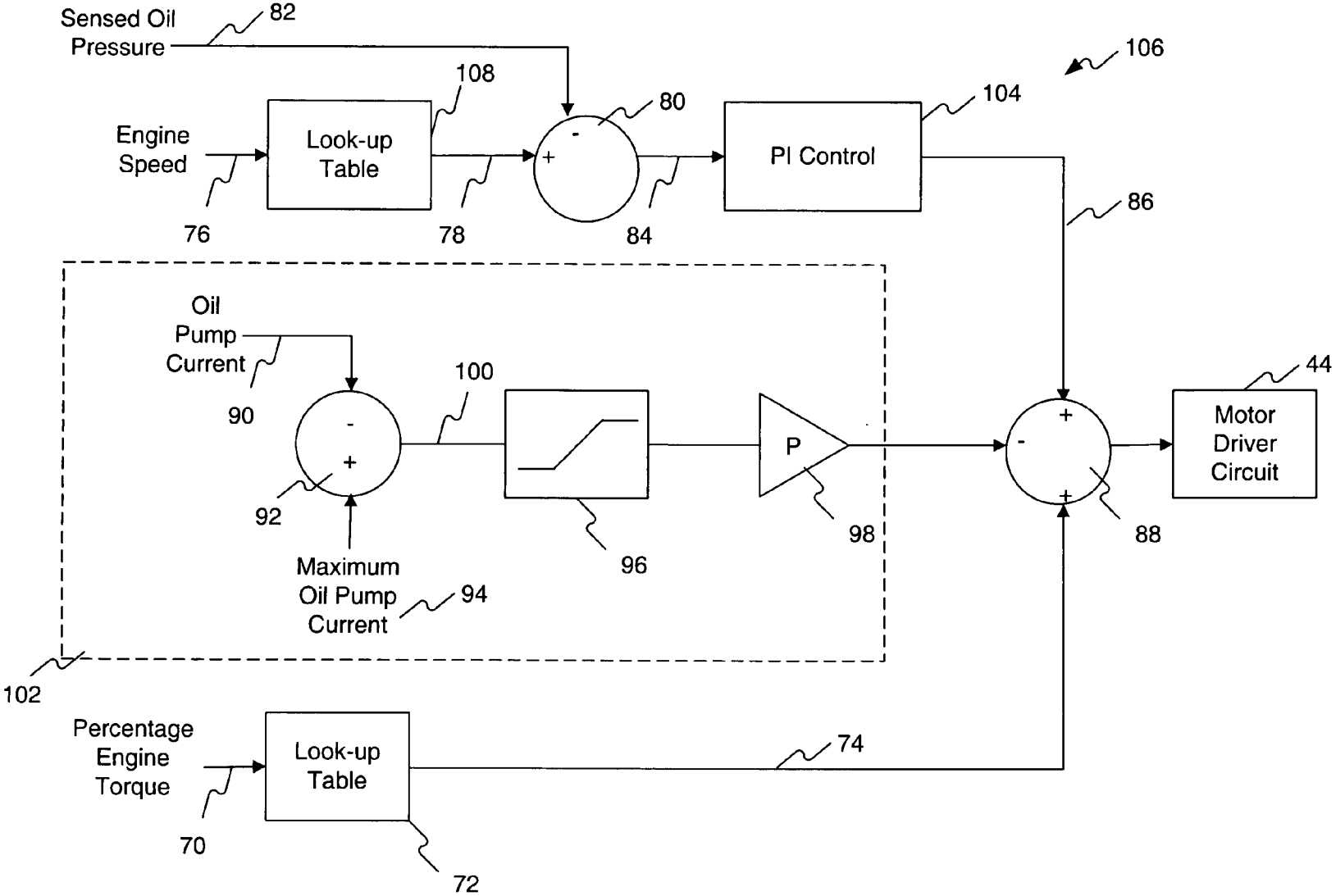
FIG. 4 is a block diagram illustrating a feedback control loop for controlling the delivery of fluid to the engine based on engine torque and engine speed.

FIG. 4 depicts a block diagram illustrating an alternative control architecture 106 for controlling oil pump speed based on both engine torque and engine speed. Percentage engine torque signal 70 is input to a look-up table 72. Percentage engine torque signal 70 is calculated by the microprocessor 22, as described previously, based on such signals representing the energy input to the engine such as air flow and fuel flow. Look-up table 72 outputs a pump speed signal 74. At zero percent torque, look-up table 72 outputs a pump speed signal 74 representing zero pumping speed. As engine torque increases, the pump speed signal 74 output by look-up table 72 increases. When percentage engine torque signal 70 reaches 80% engine torque, the pump speed signal 74 reaches its maximum value corresponding to maximum pump speed. The relationship between percentage engine torque signal 70 and pump speed signal 74 can be linear or can be a non-linear curve based on the lubrication requirements of the engine. For percentage torque values above 80%, the pump speed signal 74 remains constant at 100% pumping speed.

The control architecture 106 shown in FIG. 4 also controls the speed of the oil pump based on engine speed. An engine speed signal 76 is received from an engine RPM sensor. Engine speed signal 76 is input to a look-up table 108 that outputs a desired oil pressure 78 based on the input engine speed signal 76. Desired oil pressure 78 increases as engine speed 76 increases. Desired oil pressure 78 is input to a positive input of summer 80. A sensed oil pressure signal 82 received from an oil pressure sensor is provided to a negative input of summer 80. The summer outputs an error signal 84. Error signal 84 is provided to proportional and integral (PI) control block 104. A typical PI control block is described in detail later with respect to FIG. 6. The PI control block 104 integrates the error signal 84 so that the history of error signal 84 is taken into account when controlling the speed of the oil pump. This helps the feedback control loop achieve the desired oil pump speed.

PI control block 104 outputs a pump speed signal 86, which is input to a positive input of summer 88. Summer 88 sums pump speed signal 74 with pump speed signal 86. The output of summer 88 represents the pumping speed signal that is provided to motor driver circuit 44.

If the engine torque increases significantly, the engine oil pressure will increase due to the increased pump speed signal 74. This may cause error signal 84 to become negative for a relatively long time, and a large negative pump speed signal 86 can get built up on the output of PI control block 104 due to the integration of the error signal 84. This problem can be corrected by including anti-windup in the PI control block 104. The anti-windup feature limits the output of the integrator in PI control block 104.

An additional control algorithm 102 can be included to prevent damage to the pump by ensuring the oil pumping speed does not exceed the rated capability of the pump. Control algorithm 102 acts to slow the pump whenever the input current to the pump exceeds the maximum current rating of the pump. A sensed oil pump current signal 90 is received from an oil pump current sensor that senses the current drawn by the oil pump's electric motor. The sensed oil pump current signal 90 is provided to a negative input of summer 92. A maximum oil pump current value 94 is input to a positive input summer 92. Maximum oil pump current value 94 is a constant value that represents the maximum input current rating for the oil pump's electric motor. Summer 92 subtracts the sensed oil pump current signal 90 from the maximum oil pump current value 94. Summer 92 outputs an error signal 100 to saturation block 96. Saturation block 96 outputs a zero value when it receives a positive signal. When saturation block 96 receives a negative signal, it passes the negative signal through to its output. When oil pump current signal 90 is less than the maximum oil pump current value 94, error signal 100 is positive and the output off saturation block is zero. When sensed oil pump current signal 90 is greater than the maximum oil pump current value 94, error signal 100 is negative and the output of saturation block 96 is equal to error signal 100. The output of saturation block 96 is provided to amplifier 98, which has a scalar gain P. The output of amplifier 98 is input to a negative input of summer 88. Thus, when the oil pump current signal 90 exceeds the maximum oil pump current signal 94, control algorithm 102 acts to decrease the pumping speed of the oil pump until the speed is below the pump motor's rated current.

INDUSTRIAL APPLICABILITY

Figure 5:
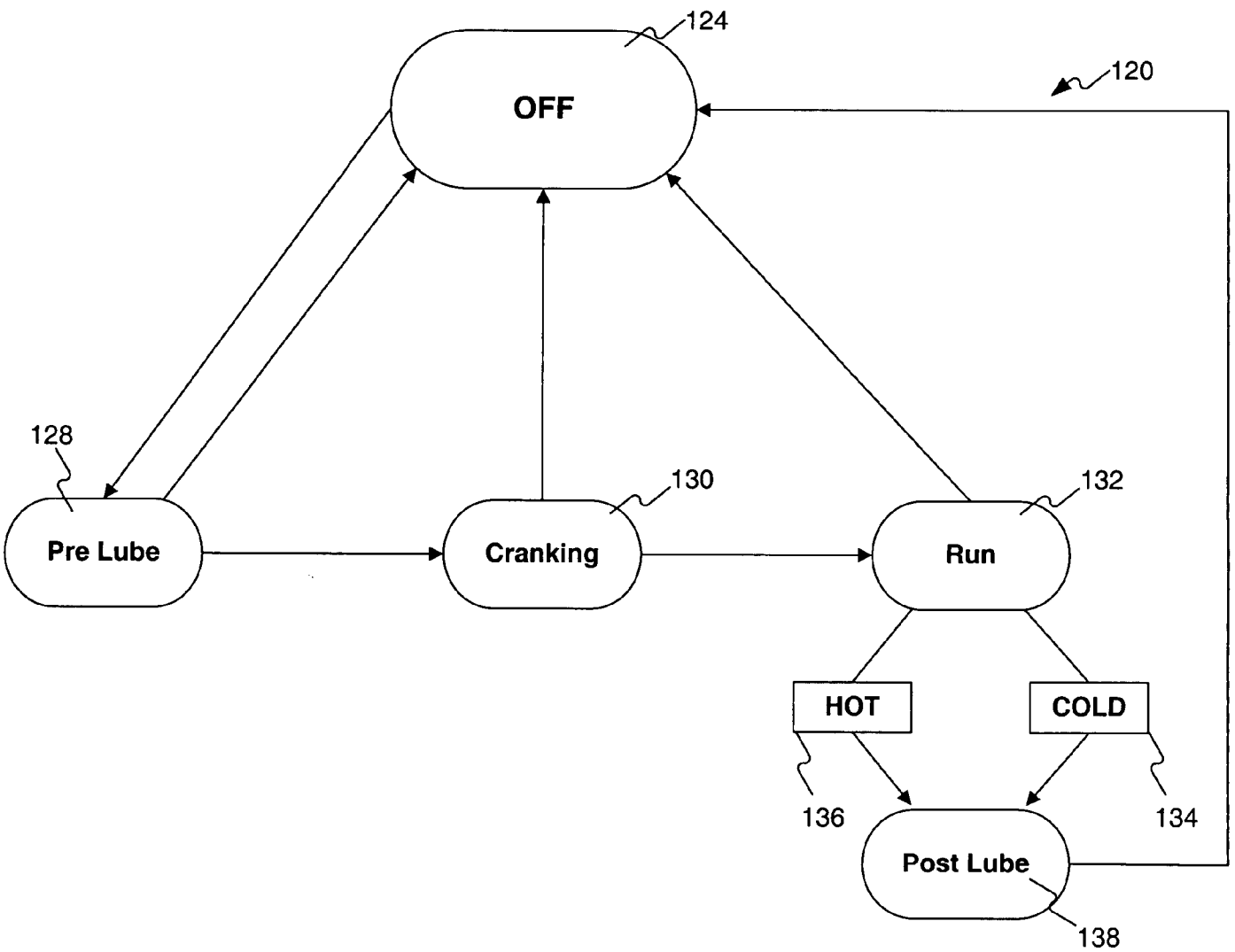
FIG. 5 is a state diagram illustrating different modes of engine operation.

FIG. 5 depicts a state diagram 120 illustrating examples of various modes of engine operation for an engine in a truck. The control algorithm for controlling the oil pump can be changed based on an engine mode of operation. The engine is initially in an Off state 124. The microprocessor determines that the engine is in Off state 124 when the truck key is in the Off position. An operator can start the engine by turning the key to Run position and then depressing a "Start" pushbutton. This starts a pre-lube mode of operation 128. The pre-lube mode of operation 128 is a mode of operation where the oil pump is operated to provide lubrication to the engine before the engine is started. If the operator turns the key to Off while the engine is in pre-lube mode, the engine returns to Off mode of operation 124. The pre-lube mode of operation 128 may last for 20 seconds and then the engine automatically may go into cranking mode 130.

When the engine speed exceeds a determined value such as 550 RPM, it is determined that the engine has exited cranking mode 130 and has entered a Run mode of operation 132. When the engine is in Run mode 132, it is either in cold oil run mode 134 or hot oil run mode 136. In certain embodiments, when the sensed oil temperature is above 40° C. the engine is in hot oil run mode 136. When the sensed oil temperature is below 40° C. the engine is in a cold oil run mode 134. When the engine is in a Run mode of operation 132, and the operator turns the key switch to Off, the engine enters a post-lube mode of operation 138. Post-lube mode of operation 138 is a mode of operation where the oil pump is operated to provide lubrication to the engine after the engine has been turned off. After the engine is in post-lube mode of operation for a predetermined period of time, the engine returns to the Off mode 124 of operation. In the Off mode of operation 124, the oil pump is shut off.

Figure 6:
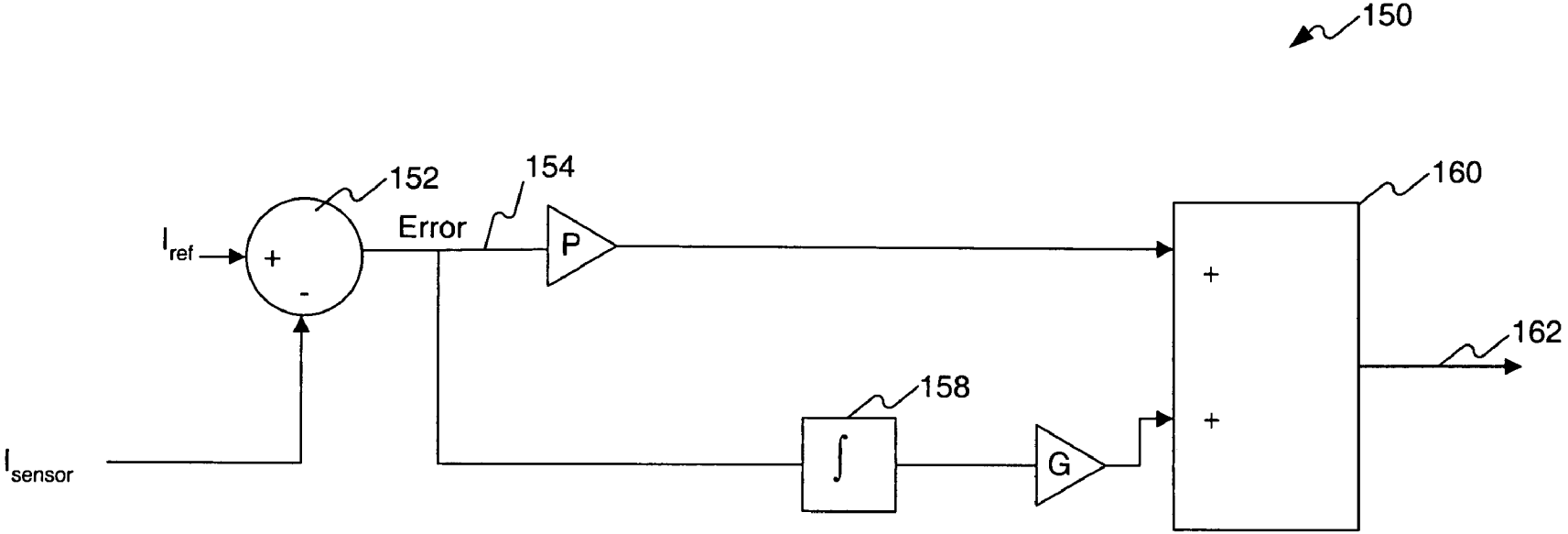
FIG. 6 is a block diagram illustrating a feedback control loop for controlling the delivery of fluid to the engine during pre-lube mode.

The pump controller can use different algorithms for controlling the pump in different engine modes of operation. FIG. 6 depicts a block diagram illustrating a feedback control loop for controlling the oil pump during pre-lube mode of operation. When the engine is in pre-lube mode of operation, microprocessor 22 controls the oil pump by maintaining a fixed current to the oil pump's electric motor.

Feedback control loop 150 is a proportional and integral (PI) control loop. $I_{sensor}$ is a sensed current signal received from the electric oil pump current sensor 32 and is representative of the current input to the oil pump's electric motor. $I_{sensor}$ is input to a negative input of summer 152. $I_{ref}$ is a constant reference current level. $I_{ref}$ can be experimentally determined by determining the optimal amount of lubrication for the engine during pre-lube.

Summer 152 outputs an error signal 154 which is the difference between $I_{ref}$ and $I_{sensor}$. Error signal 154 is multiplied by a scalar gain P and provided to summer 160. Error signal 154 is also provided to integrating block 158 and then scaled by a scalar gain G and input to summer 160. Summer 160 sums the two inputs and outputs a pump speed control signal 162. Feedback control loop 150 thereby controls the speed of the oil pump's motor so as to maintain a constant input current equal to $I_{ref}$.

When the engine is in cranking mode 130, the oil pump is shut off. When the engine is in hot oil run mode 136, the oil pump is controlled with respect to engine torque and/or engine speed as illustrated in FIGS. 3 or 4, described previously. When the engine is in cold oil run mode 134, the oil pump is controlled by the same method as during pre-lube mode; i. e. the pump controller maintains a constant oil pump current $I_{ref}$. When the oil is cold it is more viscous and requires more pumping power to pump the oil. By controlling the speed of the pump to maintain a constant oil pump current $I_{ref}$, the controller ensures that sufficient lubrication is provided to the engine when the oil is cold and viscous.

When the engine is in post-lube mode of operation 138, the engine is off and the pump control system continues to temporarily operate the oil pump to cool down the engine and especially to cool down the turbocharger bearings. During this mode of operation, the pump controller (e.g. microprocessor 22) senses oil temperature and controls oil pump speed based on sensed oil temperature. When the oil temperature is greater than or equal to 50° C. the oil pump is controlled to maintain a constant pump speed of 3000 RPM. When the oil temperature drops below 50° C. the oil pump speed is controlled linearly based on temperature. Thus, oil pump speed will decrease linearly as the oil temperature drops until the oil temperature reaches 20° C. at which point the oil pump speed will be maintained at 500 RPM. After 30 seconds of post-lube operation, the oil pump is turned off.

The disclosed pump control system can also be used in a lubrication system that uses a combination of a mechanical oil pump and an electrical oil pump connected in parallel—i.e., the pump outlets connected to a common passage. The mechanical pump is connected to the engine via belts or gears, and thus the speed of the mechanical pump is proportional to the speed of the engine. The electric pump is controlled by the pump controller of the present invention. The values used in the look-up tables of the various control embodiments may take into account the presence of the mechanical pump so that the electric pump provides an amount of oil to sufficiently lubricate the engine without wasting pumping energy.

Other embodiments of the invention will be apparent to those skilled in the art from consideration of the specification and practice of the invention disclosed herein. It is intended that the specification and examples be considered as exemplary only, with a true scope of the invention being indicated by the following claims.

What is claimed is:

1. A method of controlling the delivery of fluid to an engine, comprising:

receiving a fuel flow rate signal; and controlling the speed of an electric pump arranged to deliver fluid to the engine based on a first pump speed signal and a second pump speed signal, wherein the first pump speed siqnal is based on the fuel flow rate signal and a sensed engine speed, and wherein the second pump speed signal is based on a sensed oil pressure.

2. The method of claim 1, wherein the fluid is a lubricating fluid.

3. The method of claim 1, wherein the controlling of the speed of the electric pump is further based on an operator demand signal.

4. The method of claim 1, further comprising:

sensing an engine mode of operation, wherein the controlling the speed of the electric pump is further based on the engine mode of operation.

5. The method of claim 4, wherein the engine modes of operation include off, pre-lube, run, and post-lube.

6. The method of claim 5, wherein the controlling the speed of the electric pump further comprises:

maintaining a constant current delivered to the electric pump when the engine is in a pre-lube mode of operation or when the engine oil is below a predetermined threshold temperature.

7. The method of claim 5, wherein the controlling the speed of the electric pump further comprises:

controlling the speed of the electric pump based on oil temperature when the engine is in a post-lube mode of operation.

8. The method of claim 1, further comprising:

determining a desired oil pressure based on the engine speed signal; and comparing the desired oil pressure with the sensed oil pressure signal, wherein the controlling the speed of the electric pump is based on the comparison.

9. The method of claim 8, further comprising:

wherein the second pump speed signal is based on the comparison of the desired oil pressure with the sensed oil pressure signal, and wherein the controlling the speed of the electric pump is based on the sum of the first and second pump speed signals.

10. The method of claim 1, further comprising:

sensing input current to the electric pump; and reducing the speed of the electric pump when the sensed input current exceeds a predetermined value.

11. The method of claim 1, further comprising:

determining an engine power output based on the fuel flow rate signal, wherein the controlling of the speed of the electric pump comprises controlling the speed of the electric pump based on the engine power output.

12. An electric pump control system for controlling delivery of fluid to an engine, comprising:

a pump arranged to pump fluid to an engine;

an electric motor arranged to drive the pump;

a controller operatively coupled to the electric motor, the controller determining engine torque based on a fuel flow rate signal and controlling the speed of the electric motor based on engine torque;

an engine speed sensor operatively coupled to the controller; and an oil pressure sensor operatively coupled to the controller, wherein the controller generates a first pump speed signal based on a signal received from the oil pressure sensor and a signal received from the engine speed sensor, the controller generates a second pump speed signal based on fuel flow rate signal, and controlling the speed of the electric motor is in response to the first and second pump speed signals.

13. The system of claim 12, wherein the controller determines engine torque based on the fuel flow rate signal and an engine speed signal.

14. The system of claim 12, wherein the fluid is a lubricating fluid.

15. The system of claim 12, further comprising:

a fuel flow sensor providing a fuel flow rate signal to the controller.

16. The system of claim 12, further comprising:

an oil pressure sensor operatively coupled to the controller, wherein the controller controls the speed of the electric motor based on a comparison of an oil pressure signal received from the oil pressure sensor with a desired oil pressure, the desired oil pressure determined based on the fuel flow rate signal.

* * * * *